United States Patent [19]

Connell et al.

[11] Patent Number: 4,897,047

[45] Date of Patent: Jan. 30, 1990

[54] ELECTRICALLY AND MECHANICALLY PROGRAMMABLE ELECTRICAL APPARATUS

[75] Inventors: Alistair D. Connell, Greensboro; Donald W. K. Hughes; Allen F. VanDerStuyf, both of Kernersville, all of N.C.

[73] Assignee: AMP Incorporated, Harrisburg, Pa.

[21] Appl. No.: 230,640

[22] Filed: Aug. 10, 1988

[51] Int. Cl.[4] ..... H01R 9/09; H01H 85/02; H01H 85/14

[52] U.S. Cl. ..... 439/189; 337/256

[58] Field of Search ..... 439/78–83, 439/49, 189, 516, 621, 622; 337/186, 189, 256; 361/104

[56] References Cited

U.S. PATENT DOCUMENTS

| | | | |
|---|---|---|---|
| Re. 32,439 | 6/1987 | Narozny | 439/404 |
| 3,618,207 | 1/1967 | Sand | 29/629 R |
| 3,697,926 | 10/1972 | Krafthefer | 439/75 |
| 4,089,041 | 5/1978 | Lockard | 361/403 |
| 4,147,399 | 4/1979 | Moser . | |
| 4,552,423 | 11/1985 | Swengel, Jr. | 439/507 |
| 4,680,568 | 7/1987 | Corrao | 337/186 |
| 4,689,597 | 8/1987 | Galloway | 337/186 |
| 4,773,157 | 9/1988 | Galloway et al. | 29/863 |

*Primary Examiner*—Neil Abrams
*Attorney, Agent, or Firm*—Robert W. Pitts

[57] ABSTRACT

An apparatus in the form of an electrical connector which permits electrical programming of circuits, such as an integrated circuit component, and subsequent mechanical reprogramming of the same circuitry is disclosed. The connector includes a plurality of signal terminals and at least one ground terminal adapted to engage printed circuit board traces joining leads of an integrated circuit component. A fusible wire initially joins selected signal terminals to ground. Portions of the wire can be severed by application of an electrical potential between selected signal terminals and ground sufficient to generate a current in excess of the current carrying capacity of the wire. The terminals are held in place by an insulative body and are inserted into an insulative housing where contact can be made with a pin header having detachable pins for mechanically reprogramming the device.

30 Claims, 11 Drawing Sheets

48
46
6
44
52
62
70
66
64
30
60
36
74
22
76
34
32
6
12
10
14

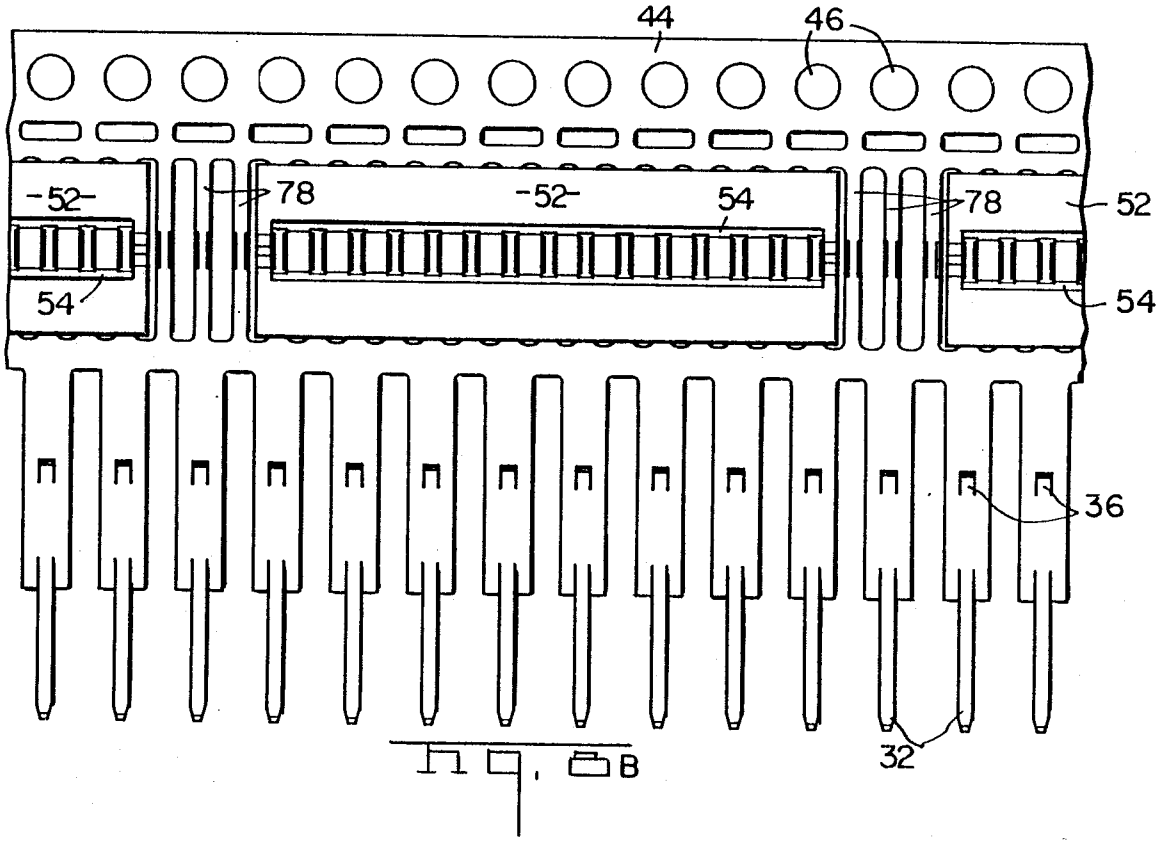
52
54
78
46
44
54
52
78
52
54
36
32
B

ELECTRICALLY AND MECHANICALLY PROGRAMMABLE ELECTRICAL APPARATUS

BACKGROUND OF THE INVENTION

1. Field of the Invention

This invention relates to an electrical apparatus of the type suitable for programming electrical circuits by selectively severing fusible means in the electrical apparatus, and more particularly this invention relates to an electrical connector or electrical component having a plurality of signal terminals which are initially attached to ground by a fusible member, the connections between individual signal terminals and ground being selectively severable upon the application of an electrical current. Furthermore, this invention relates to a connector apparatus which can be reprogrammed by electrically severing each connection from a signal terminal to ground, and attachment of an auxiliary device, itself programmed to establish electrical paths between signal and ground terminals so that the connector can be reprogrammed.

2. Description of the Prior Art

It is quite common to use subassemblies employing electronic means which are often manufactured in a configuration which is suitable for use in a number of related but different ways. The electronic components used in the standard assemblies can then be programmed for use in specific devices. For example, the same electronic subassembly could be used for a number of different sizes of the same device, but the electronic components comprising a portion of this subassembly would need to be separately programmed for each size.

One example in which such electronic subassemblies have been employed would be in electronic odometers used in automobiles. In order to achieve the economic benefits from mass production of such subassemblies, a single standard electronic subassembly might be manufactured and then programmed for use in different size automobiles. A prior art example of an electronic subassembly 2' used on an electronic odometer is shown in FIG. 1. This subassembly employs an integrated circuit component such as a dual inline package 4 to provide the logic for the odometer. The dual inline package 4 is mounted on a printed circuit board 6. A plurality of pins in the dual inline package 4 are connected to a plurality of individual traces 8 which are, in turn, initially commoned to ground. Each trace 8 has a discrete fuse 16 located between the dual inline package 4 and ground and, upon the application of an electric potential sufficient to induce a current through the individual trace 8 in excess of the current capacity of the corresponding fuse 16, that fuse will be blown or severed thus interrupting the connection between the corresponding pin and ground. In this manner, the integrated circuit component 4 can be electronically programmed for a specific use, for example for a specific automobile tire size.

The prior art subassembly 2', shown in FIG. 1, can also be mechanically reprogrammed in the event of a subsequent change in the vehicle, for example installation of a different size tire. The electrical connector 18 and the pin header 10 can be used to mechanically reprogram the subassembly 2'. In practice, a header 10, having a plurality of pins 12 attached to a ground bus 14, would be inserted into the connector establishing interconnection to the terminals in the prior art connector 18. Electrical potential could then be applied to the bus 14, thus blowing all of the remaining fuses 16 between the prior art connector 18 and ground. The pin header 10 can then be removed, and selected pins 12 can be removed from the ground bus 14. When the pin header 10 is then re-inserted in the connector 18 and the ground bus 14 is connected to ground, the pins remaining in the mechanically programmed pin header 10 will form an interconnection between the corresponding lead of the dual inline package 4 and ground. Note that the terminals in connector 10 do not interrupt the traces between the leads on the dual inline package 4 and ground.

Although this prior art subassembly does provide for both electrical and mechanical programming of an integrated circuit component, the device does have certain disadvantages. First, the device requires a number of discrete components, including the separate fuses and the connector. These separate components not only provide logistical problems, but also take up valuable space on a printed circuit board. Furthermore, it is difficult to control the precise current carrying capacity of conventional discrete fuses, and such a manufacturing variability can result in use of the wrong size fuse.

Other standard components which can be used to program an electric circuit of this type can comprise a conventional DIP switch in which individually actuatable switches can be used to program and reprogram an integrated circuit component such as a dual inline package. Although such devices provide virtually unlimited reprogramming capability, DIP switches are relatively expensive and must be mechanically accessible, and thus can add significant cost to mass produced items.

The instant invention comprises an electrical connector which can be both mechanically and electrically reprogrammed and thus would be suitable for use in a number of applications in which the device would be programmed only a limited number of times during its life.

SUMMARY OF THE INVENTION

A programmable connector for use with electrical circuitry such as an integrated circuit component consisting of a plurality of terminals interconnected by a fusible shunt, such as a relatively thin wire or filament extending between the terminals, provides an integral component suitable for mechanically and electrically programming an electrical subassembly. The wire, which comprises the fusible shunt, would have a current carrying capacity less than that of the individual terminals. When a voltage is established between an individual terminal and ground, a current in excess of the current carrying capacity of the portion of the shunt forming an electrical path between the selected terminal and ground is established, and this portion of the shunt would be severed. By attaching this fusible shunt to a terminal, including a mechanical contact spring for engaging a mechanical programming means, the device can have both electrical and mechanical programming capabilities. In the preferred embodiment of this invention, a single wire extends between sections of side-by-side terminals. A member which can be connected to ground would otherwise extend between adjacent signal terminals so that the intervening portion of the fusible wire could be severed when selected signal terminals are interconnected to a source of electric potential. In order to mechanically reprogram such a device, all fusible shunt sections can be severed and a mechanical components, such as a pin header having detachable individual pins, can be used to mate with the individual terminals, thus providing an alternative signal to ground configuration.

In the preferred embodiment of this invention, the individual terminals can be stamped and formed. The fabrication process for such a device includes uses of a molded plastic body attached to terminals initially extending from a common stamped and formed carrier strip. After the insulative body is molded or otherwise attached to the terminals, signal terminals and other portions of the stamped and formed lead frame which are not normally attached to ground, can be severed from the carrier strip which now acts as a bus between all ground elements. A thin fusible wire, having an accurately controlled current carrying capability is then disposed in a straight line in contact with portions with all of the terminals. Heat and pressure is then applied to solder the tin or tin-lead alloy coated wire directly to the individual terminals. An electrical potential can then be applied to selected terminals and selected portions of the fuse can be severed in this manner. Wire handling difficulties encountered in using a relatively thin wire, suitable for use in this invention, can be overcome by deploying a single continuous wire transversely of not only the terminals in a specific programmable connector, but also in relation to all of the terminals extending from a continuous carrier strip.

BRIEF DESCRIPTION OF THE DRAWINGS

FIGS. 8A and 8B show opposite sides of the assembly after the insulative carrier body has been molded around portions of the terminals.

FIG. 9 also shows the stamping which occurs after the insulative body is formed so that the various terminal elements can be appropriately separated.

DETAILED DESCRIPTION OF THE PREFERRED EMBODIMENT

Figure 1:
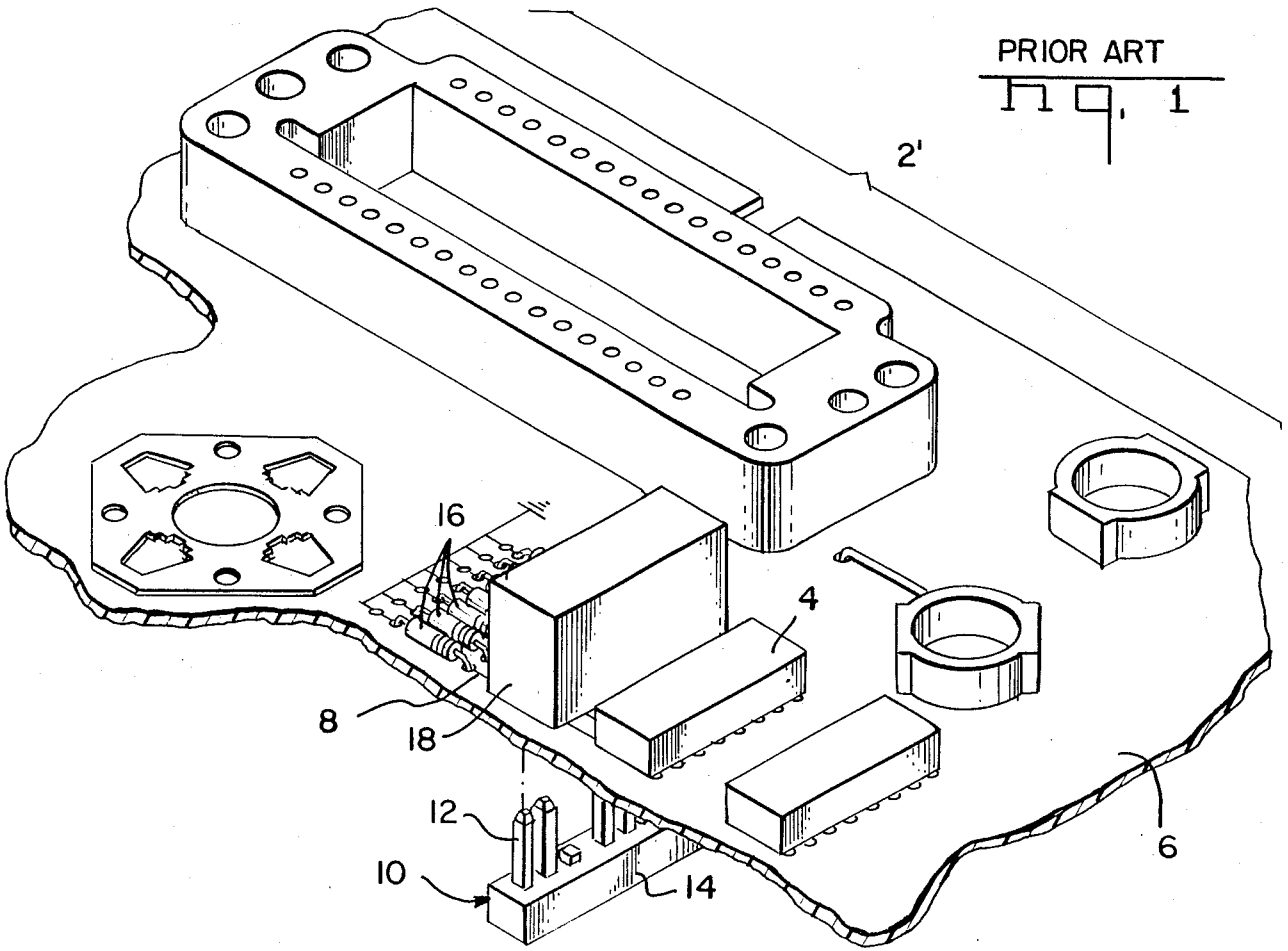
PRIOR ART Fig. 1
FIG. 1 is a view of a prior art electronic subassembly using discrete fuses to electronically program an integrated circuit component and a connector assembly to mechanically program the same integrated circuit component.
Figure 2:
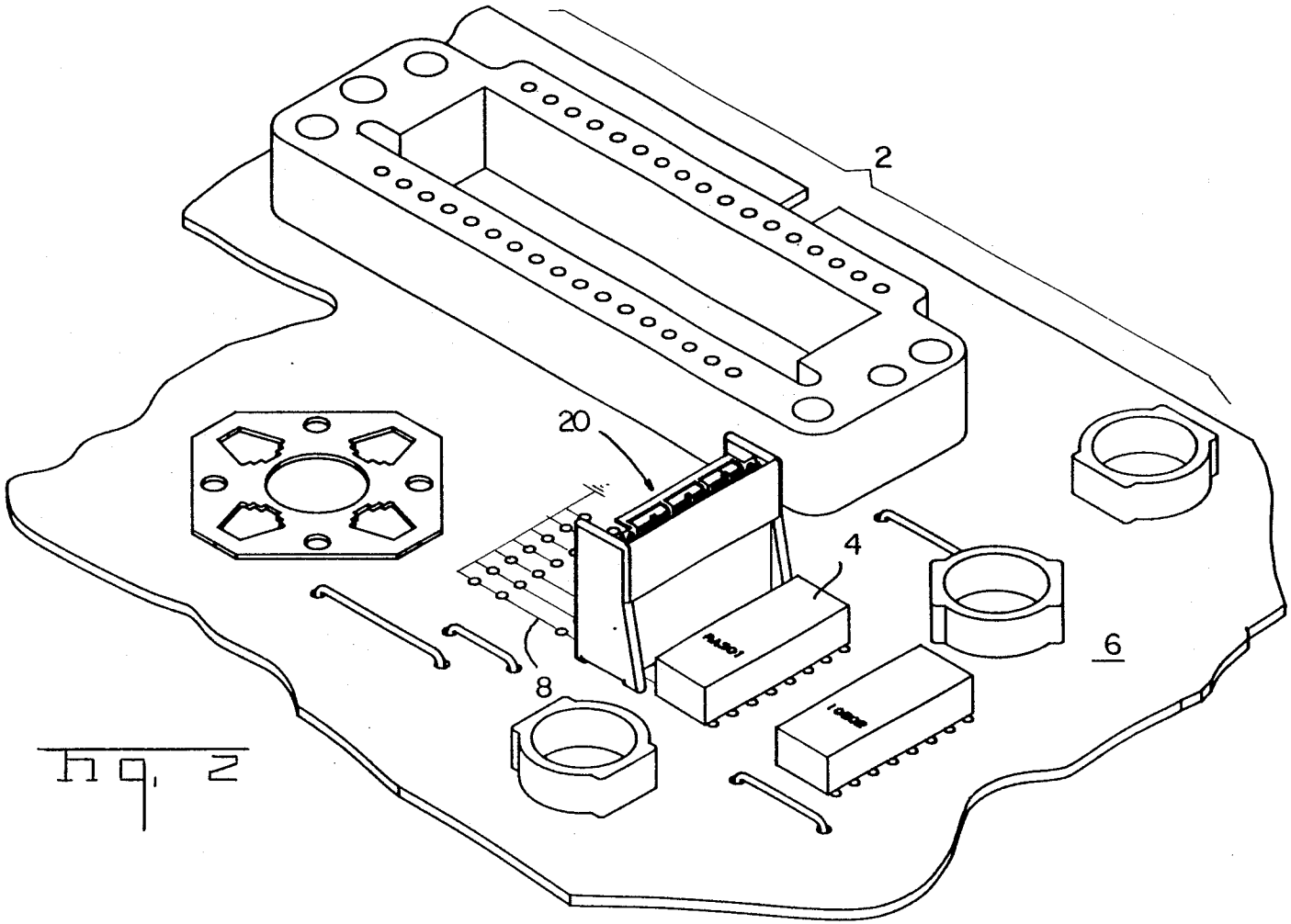
FIG. 2 is a view of an electronic subassembly using a single connector for both electrical and mechanical programming of one or more integrated circuit components.
Figure 3:
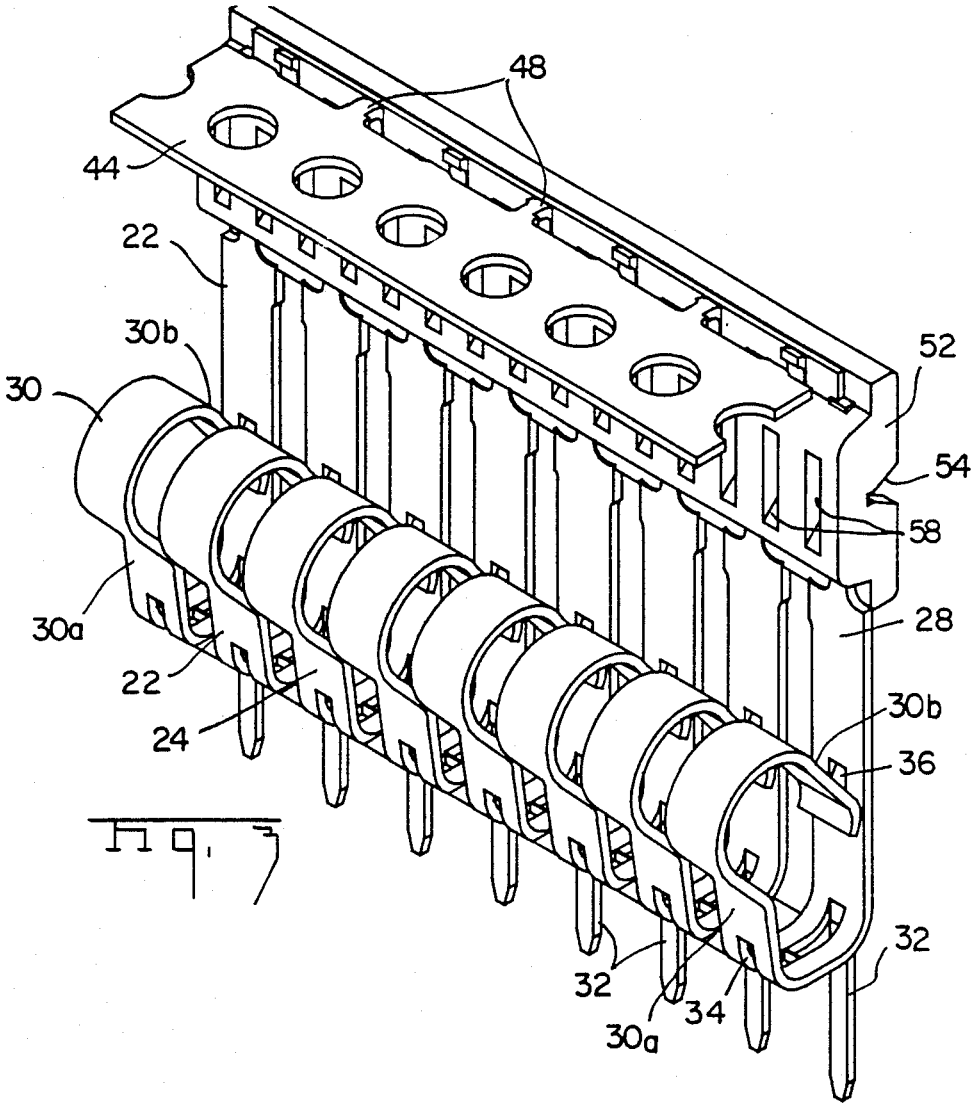
FIG. 3 is a perspective view of the terminals employed in the instant fusible connector, showing the individual terminals secured to an insulative body.

The electronic subassembly 2 including the preferred embodiment of this invention is shown in FIG. 2. The selectively reprogrammable electrical connector 20 which comprises the preferred embodiment of this invention is employed with an integrated circuit component 4 and both are mounted on a printed circuit board 6. The selectively reprogrammable electrical connector 20 which comprises the preferred embodiment of this invention can be used on the same circuit board and with the same components with which the prior art connector 18, shown in FIG. 1, is used. The printed circuit board shown in FIGS. 1 and 2 has printed circuit board traces 8 which are identical. The connector 20 can also be used with the same pin header 10 which permits mechanical reprogramming of the initially electrically programmed electrical connector 20. The fuses 16 used in the prior art configuration, however, have been replaced by the selectively mechanically and electrically programmable connector 20. Although connector 20 can be used on the same printed circuit board, the connector 20 occupies less printed circuit board area than the combination of the fuses 16 in the prior art connector 18. Therefore, other printed circuit board configurations using less printed circuit board real estate to provide a programming capability for integrated circuit components 4 can be employed when connector 20 is used.

The selectively reprogrammable electrical connector 20 comprising the preferred embodiment of this invention includes a plurality of signal terminals 22 and at least one ground terminal 24, each comprising a discrete conductive element. Each of the stamped and formed discrete conductive signal and ground terminals 22, 24 are secured to an insulative body 52. The individual terminals 22, 24 are also mounted within individual housing cavity 62 located in an insulative housing 60. In the preferred embodiment of this invention, a plurality of signal terminals 22 are located in a side-by-side configuration in a row with a single ground terminal 24, of similar configuration, located at the end of the row of terminals. Each stamped and formed signal or ground terminal 22, 24 includes a mechanical contact portion or means, a fuse or shunt contact portion or projection, and a circuit attaching portion or means. The mechanical contact portion of each of the terminals 22, 24 comprises a resilient spring contact consisting of a resilient contact loop 30 extending from a base 28. The fuse contact projection 26 extends upwardly from the resilient spring contact which forms the mechanical contact means. A solder tab 32, which comprises means for attaching the terminal to traces on a printed circuit board, extends downwardly from the resilient spring contact portion.

In the preferred embodiment of the invention depicted herein, the solder tab 32 is stamped from the resilient contact loop 30, forming a cutout 34. The resilient contact loop 30 includes first and second sections **30*a*, 30*b*, each of which extend generally at an arcuate angle relative to the base 28. The first leg 30*a* is joined to the base 28 by an intermediate section and extends away from the base. The second section 30*b* is joined to the first section by another intermediate section which is spaced from the point at which the resilient contact loop 30 joins the base 28. The second section 30*b* has a free end which is located adjacent to the base 28. A housing lock 36 in the form of a tab stamped from the base 28 extends in the opposite direction from the resilient contact loop and comprises means for securing the individual terminals in the cavity 62 of the insulative housing 60. The fuse contact projection 26 comprises an extension which lies in the same plane as base 28. Although extending from opposite ends of the base 28, the fuse contact projection 26 and the solder tab 32** are generally coplanar in the embodiment of the invention depicted herein.

Figure 4:
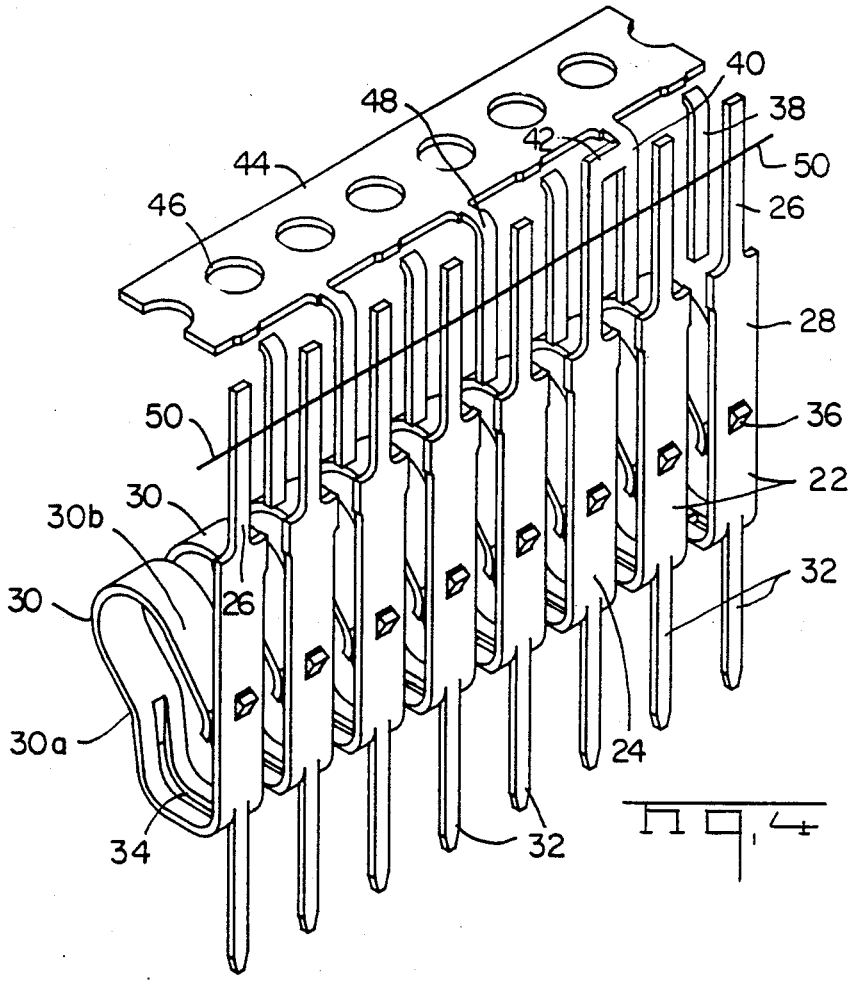
FIG. 4 is a illustrative view, in which the insulative body is not shown, so that the construction of the individual terminals and the ground configuration can be shown in more detail.
Figure 5:
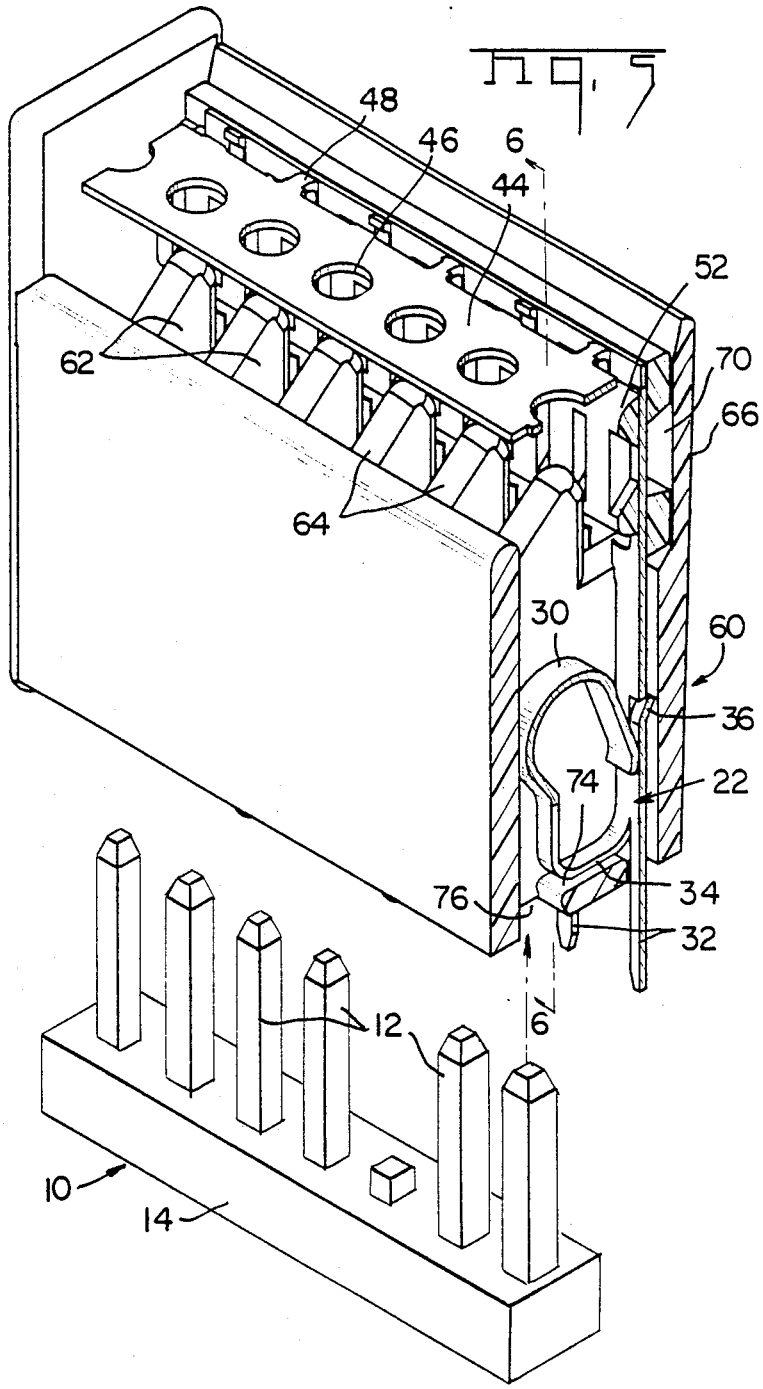
FIG. 5 is a perspective view partially in section of the electrical connector with the terminals mounted therein.
Figure 6:
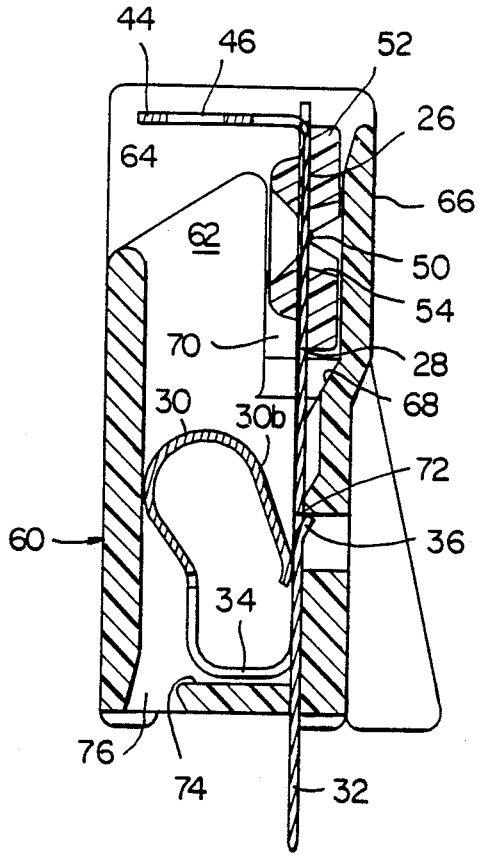
FIG. 6 is a sectional view taken along section lines 6—6 of FIG. 5.

In the preferred embodiment of the invention, the single ground terminal 24 is joined to a laterally extending commoning member 44. As will be subsequently described, this commoning member 44 comprises the carrier strip from which each of the terminals extend during the initial fabrication stage. In the final configuration of the terminal assembly, as depicted without showing the insulative body in FIG. 4, a plurality of auxiliary ground members 40 also extend from the commoning carrier strip 44. Each of these auxiliary ground members 40 is adjacent to a fuse contact projection 26 and extends between fuse contact projections 26 of otherwise adjacent terminals. The auxiliary ground member 40 extending between the fuse contact portions of the single ground terminal 24 and the adjacent signal terminal 22 is joined to the fuse contact projection 26 of the ground terminal 24 by a link 42. Auxiliary ground members 40 extending between fuse contact portions 26 of otherwise adjacent signal terminals are joined only to the common carrier 44 and are not in contact with the signal terminals 22.

Filament contact members in the form of dummy legs 38, which are not joined directly to the common carrier 44, are positioned between the fuse contact portions of otherwise adjacent terminals 22. In the preferred embodiment of this invention, the fuse contact projections 26 of the signal terminals 24 are each adjacent to one auxiliary ground member 40. However, this leaves two signal terminals 22 between each pair of auxiliary ground members 40. The filament contact means or dummy legs 38 are positioned between the fuse contact projections 26 of the two signal terminals 22 which are located between each pair of auxiliary ground members 40. The dummy legs 38 and the auxiliary ground members 40 comprise discrete conductive elements in addition to the signal and ground terminals 22 and 24. These discrete conductive elements, in the form of stamped and formed contact members, are fabricated from a conventional resilient conductive metal of the type commonly used for contact terminals in electrical connectors. Each of the discrete conductive elements is tin-lead plated.

Each discrete conductive element is at least partially embedded in a common insulative member in the form of an elongate insulative body 52. In the preferred embodiment of this invention, this insulative body 52 comprises a common insulative plastic which is overmolded around portions of each discrete conductive element. This overmolded insulative body is formed by a conventional molding process such as dam bar molding and, in the preferred embodiment, a conventional insulative material such as Valox can be employed. Valox is a trademark of General Electric.

The insulative body 52 is partially molded over the fuse contact portion 26 of each terminal 22, 24. The insulative body 52 is also molded over the auxiliary ground members 40 and the filament contact dummy legs 38. The resilient spring contact, including loop 30, extends beyond the lower edge of the insulative body 52 and is not affected by the presence of the plastic insulative body 52. As will subsequently become apparent, the insulative body 52 holds each of the discrete conductive elements, including the terminals 22, 24 and the auxiliary ground members 40 and the filament contact dummy legs 38 in side-by-side position. The common carrier strip 44, as well as the carrier strip links joining the auxiliary ground members 40 to the carrier strip 44 extends outwardly beyond the upper edge of the insulative body 52. The upper ends of the dummy legs 38 also project beyond the upper edge of the insulative body 52. Since the signal terminals 22 and ground terminals 24 are separate, one from the other, the discrete conductive elements are held in side-by-side position only by the presence of the insulative body 52. Insulative body 52 is not shown in FIG. 4 because this illustration is primarily intended to show the structure of the discrete conductive elements, which would be observed by the presence of insulative body 52.

A laterally extending groove 54, located intermediate the upper and lower edges of the insulative body 52, extends along the entire length of body 52 and exposes a portion of the fuse contact projection 26, the filament contact dummy legs 38, and the auxiliary ground members 40. In the preferred embodiment of this invention, a pair of wire guides 56 in the form of raised pedestals, each having a slot, are located adjacent the opposite ends of the insulative body 52. A opening 58, in line with each discrete conductive element embedded within the insulative body 52, extends into the insulative body on the opposite side from groove 54. These solder openings 58 also expose a portion of each fuse contact projection 26, filament contact dummy leg 38, and auxiliary ground member 40. The exposed portion of the discrete conductive elements, embedded within the common insulative member 52, are aligned in a straight line within the overmolded continuous insulative means so that, in the preferred embodiment, the common insulative body 52 is open on each side, exposing a portion of the fuse contact means 26, the filament contact means 38, and the auxiliary ground members 40 disposed adjacent the fuse contact means 26.

Before the connector 20 is electrically programmed, a single conductive filament in the form of an initially continuous single wire is secured in electrical contact with the exposed portions of each discrete conductive element within the groove 54 of the insulative body 52. In the preferred embodiment of this invention, the wire 50 comprises a tin plated annealed copper and nickel alloy wire having a diameter on the order of 0.001–0.0015 inch. This wire 50, which comprises a fusible means, has a current carrying capacity which is less than the discrete conductive elements, such as the signal terminals 22 and the ground terminals 24. Since the groove 54 extends transversely of all of the conductive elements in a single connector 20, a wire 50 positioned within groove 54 will also extend transversely of all of the conductive elements so that it can be soldered to each discrete conductive element. Solder joints 50*a* are formed between the wire 50 and each of the discrete conductive elements by the application of heat and pressure. As will be subsequently described, a soldering fixture can be used to apply heat and pressure at the point where the wire 50 traverses each discrete conductive element within groove 54. Since the wire and the discrete conductive elements are exposed on one side of the insulative body 52 within groove 54 and the discrete conductive elements are exposed on the opposite side by virtue of the presence of solder openings 58. When heat and pressure are applied in this manner, portion 50*b* of each wire 50 extending between adjacent discrete conductive elements is curved. Curvature of the wire in this manner thus provides slack so that subsequent thermal stresses will not result in breakage of the wire 50. Thus the wire 50 will be curved between the fuse contact projections 26 and the adjacent auxiliary ground members 40, as well as between the fuse contact projections 26 and adjacent filament contact means 38.

The subassembly, consisting of the insulative body 52 securing the discrete conductive elements side-by-side in the same plane, can be inserted in an insulative housing 60 with the longer discrete conductive elements consisting of the signal terminals 22 and ground terminals 24 being positioned within individual side-by-side housing cavity 62. The subassembly, consisting of the insulative body 52 in the discrete conductive element, includes discrete conductive elements in the form of a first and second group, one group comprising relatively longer ground and signal terminals 22, 24 extending substantially beyond the lower edge of the insulative body 52, and a second group of shorter discrete conductive elements comprising the filament contact dummy legs 38 and the auxiliary ground members 40.

The insulative housing 60 has a plurality of cavities 62 extending between the upper and lower surfaces. The cavities 62 are positioned side-by-side in a single row with individual cavities being separated by sidewalls 64. A common backwall 66 forms the rear of each housing cavity 62, and the sidewalls 64 are integral with the lower portion of the backwall 66. The backwall includes an intermediate angled step 68 above the point where the sidewalls 64 join the backwall 66. A laterally extending body cavity 70 is formed at the top of the housing. This body cavity is wide enough to receive the insulative body 52 when the terminals 22, 24 are inserted into cavities 62. A locking shoulder 72 is formed in each cavity 62 in position to engage the housing lock 36 extending from the base 28 of each terminal. Engagement of the housing lock 36 on the terminal with the locking shoulder 72 prevents removal of the terminals from their respective cavities. Pin apertures 76 extend through the lower surface 74 of the housing to receive pins 12 on pin header 10, which comprise selectively detachable contacts which are mechanically matable with the resilient contact loops 30 of the terminals when the contact pins are inserted through the pin apertures 76 into cavity 62 for engagement with the corresponding terminal.

Fabrication And Programming

Figure 7:
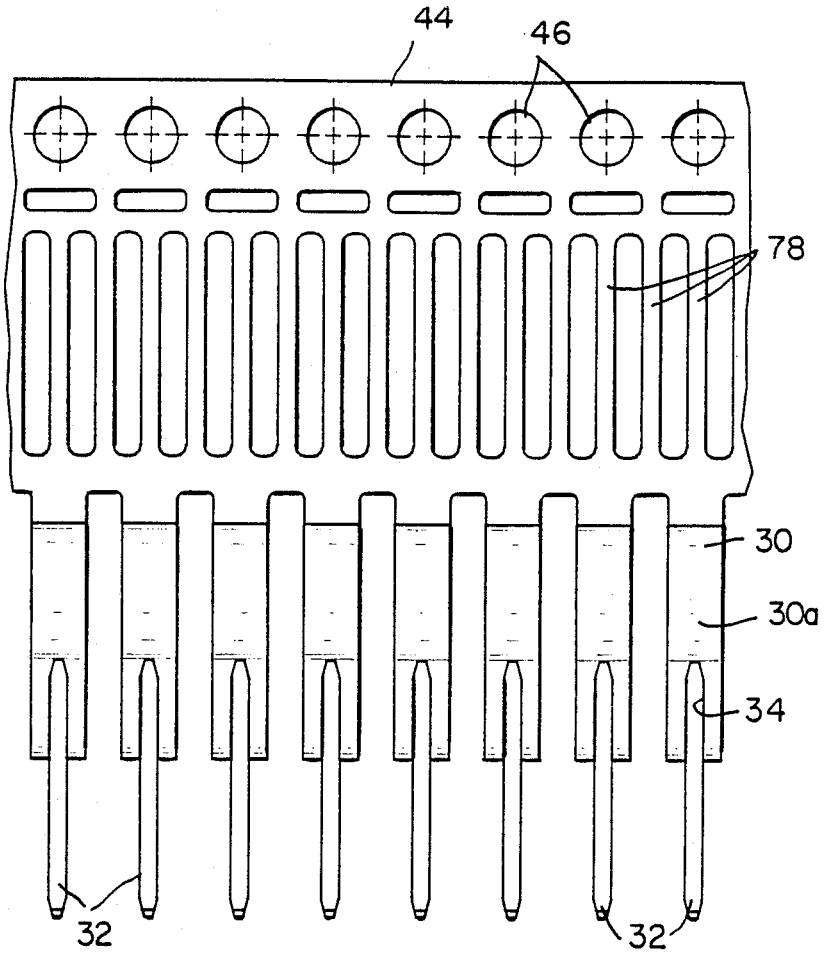
FIG. 7 is a view of the lead frame stamping after the terminals have been formed. This comprises an initial step in the assembly procedure.
Figure 1:
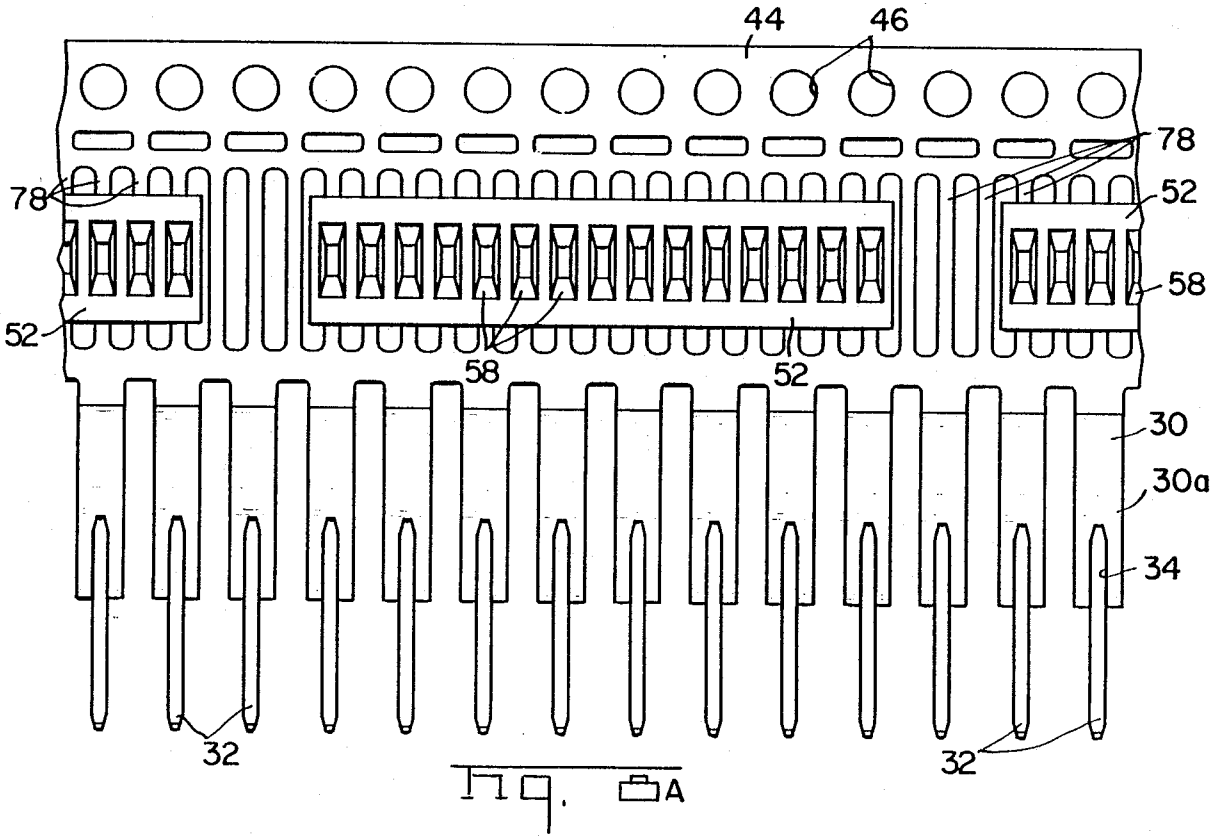
Figure 9:
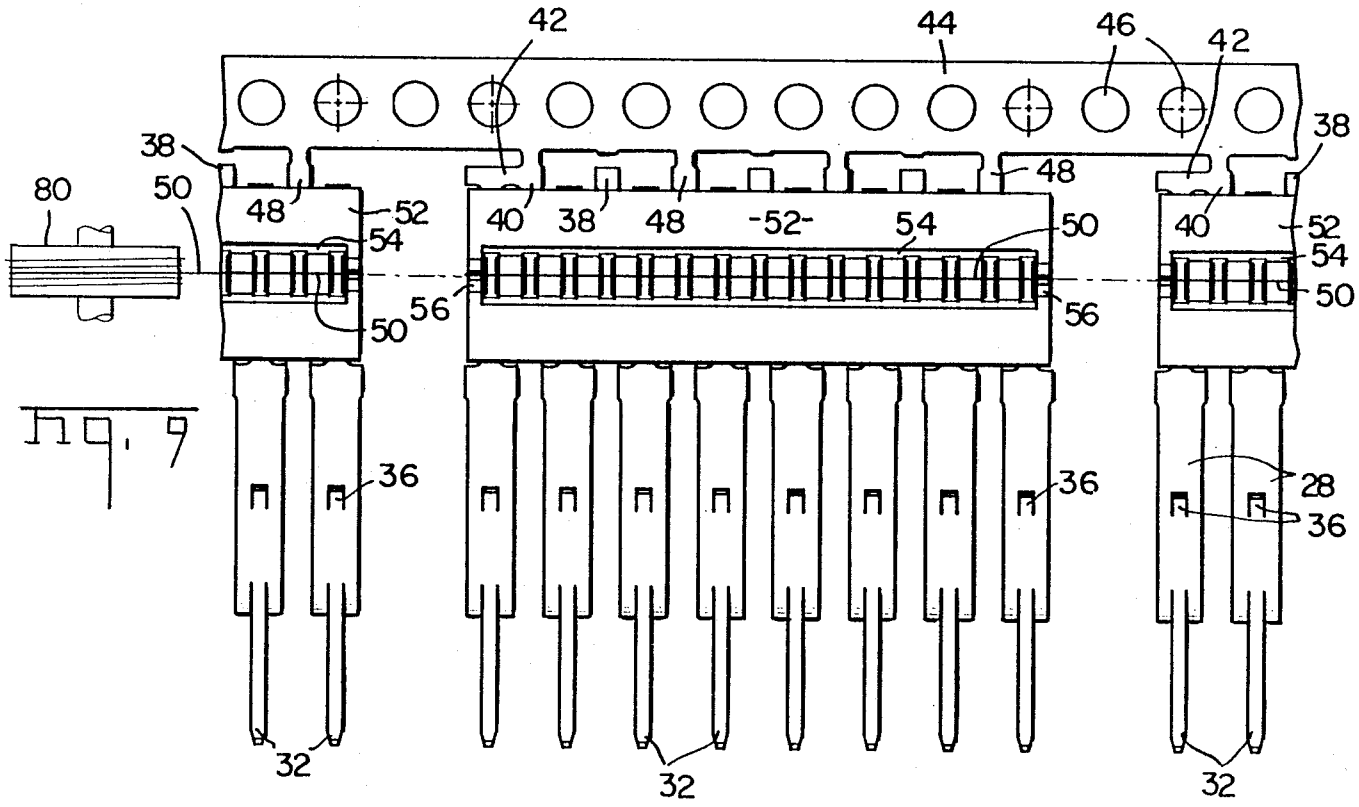
FIG. 9 shows the manner in which the wire is continuously positioned for engagement with the terminals.
Figure 10:
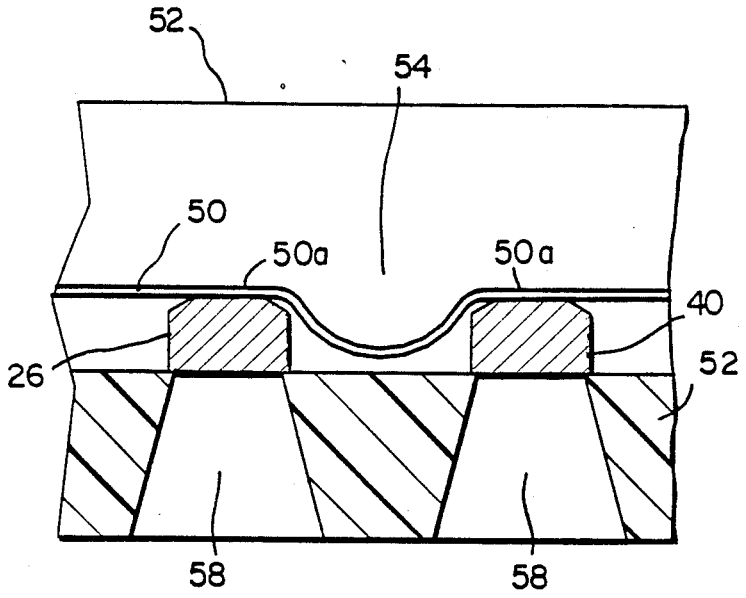
FIG. 10 is a fragmentary view showing the manner in which the wire between adjacent solder terminations is curved to provide sufficient slack to account for flexure and deformation of the assembly.

FIGS. 7–9 depict the manner in which the connector 20 is fabricated and initially electrically programmed. FIG. 7 shows a lead frame consisting of a plurality of terminals extending from the common carrier strip 44 having a plurality of evenly spaced pilot holes for advancing the carrier strip through the stamping and forming operations and assembly of the connector 20. The lead frame shown in FIG. 7 depicts a plurality of discrete conductive elements having formed mechanically contacting means in the shape of resilient loop 30 with solder tabs 32 depending therefrom. The fuse contact projection, filament contact dummy legs, and auxiliary ground members have only been partially stamped at the point in the fabrication process depicted in FIG. 7.

The next step in the fabrication process is depicted in FIGS. 8A and 8B which show opposite sides of a subassembly including partially stamped and formed terminals and an overmolded insulative body 52. FIG. 8C is a section view of including partially stamped and formed terminals and an overmolded insulative body 52. FIG. 8C is a section view of the subassembly depicted in FIGS. 8A and 8B. As shown in FIG. 8A, the insulative body 52 has been molded over the upper part of the lead frame. FIG. 8A shows the individual solder openings 58 which are in registry with segments 78 of the lead frame which extend from the carrier strip 44 towards the resilient contact loops 30. The opposite face of the overmolded insulative body 52 is shown in FIG. 8B, showing the groove 54 which exposes portions of the discrete terminal extensions 78. Wire guides 56 are located at opposite ends of a single molded insulative body in alignment with the exposed portions of the terminal extensions 78 within groove 54. Note that the molded insulative bodies 52 are formed while the terminals are still on a continuous carrier strip. A carrier strip having discrete insulative bodies formed intermittently along its length in the configuration of FIGS. 8A–8C can be fabricated at an initial stage of the operation and stored on reels for later use in the subsequent assembly operations.

The next steps in fabrication of the subassembly consisting of the insulative body 52 having discrete conductive elements extending therefrom is shown in FIG. 9. Two separate steps are depicted in FIG. 9. First, FIG. 9 shows a stamping operation in which additional material is removed from the lead frames, both above and below the insulative body 52. The additional material stamped out of the lead frame effectively separates the signal terminals 22 from each other and from the ground terminal 24 and separates the signal terminals from the filament contact dummy legs 38 and the auxiliary ground members 40. Note that the auxiliary ground members 40 remain in contact with the common carrier strip 48, which remains in contact with the ground terminals. Signal terminals 22 are separated from the carrier strip 44 as are the filament contact dummy legs 38. FIG. 9 does not show one subsequent stamping operation in which the carrier strip is separated between adjacent subassemblies. Each such subassembly would have one insulative body 52. FIG. 9 also illustrates the deployment of the wire filament 50 transversely of the discrete conductive elements so that the wire 50 is located within grooves 54 and held by the wire guides 56. FIG. 9 shows that an initially continuous single wire 50 is deployed from a common source 80 so that initially the wire 50 extends between a plurality of subassemblies while the plurality of subassemblies are still joined to a single common carrier strip 44. As the wire 50 is deployed in this fashion, heat and pressure are applied to the opposite side of the subassembly at a soldering station so that a fused contact joint 50*a* can be formed by applying heat and pressure at the point where the wire 50 overlaps portions of the discrete conductive elements which are exposed within groove 54. Since the discrete conductive elements are exposed at the rear through solder openings 50*a* and at the front within groove 54, the tin on the wire and on the terminal can reflow to form a fuse solder joint.

After the wire 50 has been deployed in the manner depicted in FIG. 9, the portion of the wire 50 extending between adjacent insulative bodies 52 can be either mechanically or electrically severed. If the fusible shunt member is to be electrically programmed while still on the carrier strip, then that portion of the carrier strip extending between adjacent insulative bodies can be electrically removed by applying a current in excess of the current carrying capacity of the wire between adjacent terminals. The electrical programming of the individual subassemblies can either occur while the subassemblies are on the carrier strip 44 or after the individual subassemblies have been separated. In order to electrically program an individual subassembly, an electrical potential is applied to selected signal terminals 22 so that a current in excess of the current carrying capacity of the single filament wire extending from the appropriate signal terminal to a grounded member is in excess of the current carrying capacity of that wire. Thus, if the carrier strip 40 is grounded, and a electric potential is applied to one signal terminal, the portion of the single filament between the fuse contact projection 26 of that signal terminal and the adjacent auxiliary ground member 40 will be severed. In order to ensure that no portion of the filament 50 forming an electrical path between two signal terminals remains intact, an electrical potential must be established to all signal terminals and each of the dummy legs 38 between otherwise adjacent signal terminals 22 must be grounded. This step requires that the filament contact dummy legs 38 must be separate from the ground terminal 30, the auxiliary ground members 40, and the carrier strip 44. The insulative body 52 holds these otherwise separate dummy legs 38 in position.

Although the connector 20 can be electrically programmed so that certain selected terminals have an electrical path to a ground connection through wire 50, thus programming selected circuits which, in the preferred embodiment of the invention, comprise traces on the printed circuit board joined to leads on an integrated circuit component, the connector 50 can be subsequently mechanically programmed. In order to mechanically reprogram connector 20, all of the remaining portions of the wire 50 can be severed by inserting pin header 10, with all pins 12 intact, into the connector housing 60. An electrical potential is then applied between all of the signal terminals and ground terminals through the pin header 10. Thus, the wire 50 will be severed between all terminals and no ground path through the wire 50 will remain. The pin header 10 can then be removed and selected pins can be mechanically detached from the common bus 14 forming the base of the pin header. Re-insertion of the pin header 10 will then establish a ground connection only between signal terminals 22 which are in engagement with the remaining pins 12 on the pin header 10.

It should be understood that the embodiment of the invention depicted herein merely constitutes the best mode now envisioned by practicing the invention. This mode is specifically adapted to provide reprogramming capability for an integrated circuit component mounted on a printed circuit board. Other configurations in which for example, the structure of the mechanical contact means might differ significantly from that depicted herein, might be suitable for other applications. Alternative fabrication techniques can also be employed. For example, an insulative film could be bonded to portions of the individual terminals as an alternative to the overmolding process depicted herein. Alternatively, the insulative body could be formed by extrusion. Thus, the invention as set forth in the following claims is not limited to the best mode of practicing the invention depicted herein.

We claim:

1. A programmable connector comprising: a plurality of terminals, each including fuse contact means; a plurality of ground members, at least one ground member disposed adjacent the fuse contact means of each terminal; a single filament having a current carrying capacity less than each said terminal and each said ground member initially extending between a plurality of said terminals and a plurality of said ground members; and a plurality of filament contact dummy legs disposed between otherwise adjacent terminals, portions of the single filament between selected terminals and a ground member and between each said filament contact dummy leg and adjacent ones of said terminals capable of being selectively severed by application of a current, between the selected terminals and an adjacent one of said ground members or between selected filament contact dummy legs and an adjacent one of said terminals, in excess of the current carrying capacity of the single filament, a ground connection being maintained between other terminals and at least one of said ground members.

2. The programmable connector of claim 1 wherein a plurality of the ground members disposed adjacent fuse contact means are commoned.

3. The programmable connector of claim 2 wherein the filament contact dummy legs are separate from the ground members.

4. The programmable connector of claim 1 wherein the fuse contact means, the ground members and the filament contact dummy legs are disposed side by side in the same plane.

5. The programmable connector of claim 1 wherein the fuse contact means, the ground members and the filament contact dummy legs are at least partially embedded in a common insulative member.

6. The programmable connector of claim 5 wherein the insulative member is at least partially open along at least one side exposing at least a portion of each fuse contact means, each ground member and each filament contact dummy leg, the filament being joined to the exposed portion of each fuse contact means, each ground member and each filament contact dummy leg, each filament capable of being selectively severed therebetween.

7. The programmable connector of claim 6 wherein the exposed portions of each fuse contact means, each ground member and each filament contact dummy leg are aligned in a straight line.

8. The programmable connector of claim 1 wherein the single filament comprises a plated annealed copper and nickel alloy wire having a diameter on the order of 0.001–0.0015 inch.

9. The programmable connector of claim 1 wherein the single filament comprises a wire, the wire being curved between fuse contact means of each terminal and the ground members and filament contact dummy legs.

10. The programmable connector of claim 1 wherein each fuse contact means comprises one portion of a terminal also having a resilient spring contact.

11. An electrical connector for use in mechanically and electrically programming electrical circuits comprising:

a plurality of signal terminals and at least one ground terminal, each terminal including a mechanical contact means and a fuse contact means;

electrically programmable fuse means initially forming at least a portion of an electrical path between the fuse contact means of each signal terminal and the fuse contact means of at least one ground terminal, the fuse means having a current carrying capacity less than the current carrying capacity of the terminals;

a mechanically programmable member having a plurality of contacts individually selectively detachable from common interconnection means, each contact being matable with the mechanical contact means; and an insulative housing in which the signal and the ground terminals are positioned, the insulative housing including contact receiving openings into which the individual contacts on the mechanical programmable member can be inserted so that the individual contacts engage the mechanical contact means, whereby the electrical circuits can be initially electrically programmed by severing portions of the fuse means between selected signal terminals and ground and the electrical circuits can be subsequently reprogrammed by severing all remaining portions of the fuse means and inserting a mechanically programmable member having selected contacts detached from the common interconnection means into engagement with the mechanical contact means.

12. The electrical connector of claim 11 wherein the terminals are positioned side by side with the fuse contact means of all the terminals being parallel.

13. The electrical connector of claim 12 wherein the terminals are stamped and formed with the fuse contact means comprising projections integral with and extending upwardly from the mechanical contact means.

14. The electrical connector of claim 13 wherein each terminal includes means of attaching the terminal to an electrical circuit formed on a circuit board.

15. The electrical connector of claim 14 wherein the attaching means extend downwardly from the mechanical contact means.

16. The electrical connector of claim 15 wherein the mechanical contact means comprises a resilient spring contact.

17. The electrical connector of claim 16 wherein the fuse contact means of each terminal is at least partially embedded in a common insulative body.

18. The electrical connector of claim 17 wherein a plurality of ground terminals are joined by a common carrier.

19. The electrical connector of claim 18 wherein the fusible means comprises an initially continuous single wire attached to the fuse contact means of each terminal.

20. The electrical connector of claim 19 further including a dummy leg between fuse contact means of otherwise adjacent signal terminals, the wire initially being attached to each dummy leg, the dummy legs otherwise being separate from the terminals.

21. An apparatus for use in programming an integrated circuit component by shunting selected circuits connected to the integrated circuit component to ground, the apparatus comprising:

a plurality of signal terminals and at least one ground terminal, each terminal comprising a stamped and formed member having a resilient contact portion, a circuit contact portion and a shunt contact portion;

an insulative body attached to the shunt contact portion of each terminal, the terminals being held in side by side relation by the insulative body;

a wire initially attached to the shunt contact portion of each terminal;

an insulative housing having a plurality of cavities in which the terminals are positioned, whereby portions of the wire forming at least a portion of the electrical path between selected signal terminals and at least one ground terminal can be severed leaving the remaining terminals shunted to ground before the apparatus is positioned with the circuit contact portions of the terminals connected to the circuits connected to the integrated circuit component.

22. The apparatus of claim 21 wherein the housing cavities are each configured to receive individual pins in a position to engage the resilient contact portions of corresponding terminals, whereby interconnection of the pins to ground will shunt other signal terminals to ground.

23. The apparatus of claim 21 wherein the insulative housing is configured to be mounted on a printed circuit board on which the integrated circuit component is mounted, the electrical circuits connected to the integrated circuit component comprising traces on the printed circuit board, the circuit contact portion of each terminal comprising means for attachment to an integrated circuit component.

24. The apparatus of claim 23 wherein the resilient contact portion of each terminal comprises a base and a loop reversely formed relative to the base, the circuit contact portion of each terminal comprising a leg extending from the base and stamped from the portion of the terminal otherwise forming the loop.

25. The apparatus of claim 24 wherein the shunt contact portion extends from the base on the opposite side from the circuit contact portion.

26. The apparatus of claim 25 wherein shunt contact elements, having a configuration corresponding to the shunt contact portions of the terminal are located between the shunt contact portions of otherwise adjacent terminals.

27. The apparatus of claim 26 wherein the shunt contact portion of each ground terminal is attached to a carrier strip and some of the shunt contact elements are attached to the carrier strip.

28. The apparatus of claim 21 wherein the insulative body comprises a molded member having a straight groove extending transversely to the terminals in which the wire is positioned.

29. The apparatus of claim 28 wherein the wire is soldered to each terminal.

30. The apparatus of claim 29 wherein the wire comprises a plated wire having a diameter on the order of 0.001–0.0015 inch, the wire being curved between points where the wire is soldered to shunt contact portions of each terminal.

* * * * *